US011830384B2

(12) United States Patent
Kirschner

(10) Patent No.: US 11,830,384 B2
(45) Date of Patent: Nov. 28, 2023

(54) NEVER-ENDING CALENDAR

(71) Applicant: Kenneth Kirschner, Farmington, NM (US)

(72) Inventor: Kenneth Kirschner, Farmington, NM (US)

(73) Assignee: BIANHUA CONNECTS LLC, Farmington, NM (US)

( * ) Notice: Subject to any disclaimer, the term of this patent is extended or adjusted under 35 U.S.C. 154(b) by 297 days.

(21) Appl. No.: 17/499,351

(22) Filed: Oct. 12, 2021

(65) Prior Publication Data

US 2022/0114917 A1 Apr. 14, 2022

Related U.S. Application Data

(60) Provisional application No. 63/089,810, filed on Oct. 9, 2020.

(51) Int. Cl.

| | |
|---|---|
| ***G09D 3/00*** | (2006.01) |
| ***B42D 5/04*** | (2006.01) |
| ***G09D 3/08*** | (2006.01) |
| ***G04B 19/24*** | (2006.01) |
| ***G09D 3/12*** | (2006.01) |

(52) U.S. Cl.
CPC ..... *G09D 3/12* (2013.01)

(58) Field of Classification Search
CPC ..... G09D 3/00; G09D 3/04; G06Q 10/109
See application file for complete search history.

(56) References Cited

U.S. PATENT DOCUMENTS

| | | | | | |
|---|---|---|---|---|---|
| 633,520 | A * | 9/1899 | Knight | G09D 3/02 | 40/115 |
| 896,255 | A * | 8/1908 | Sumerall | G09D 3/06 | 40/111 |
| 1,345,150 | A * | 6/1920 | Edwards | G09D 3/04 | 40/117 |
| 1,374,532 | A * | 4/1921 | Spillman | G09D 3/04 | 283/2 |

(Continued)

FOREIGN PATENT DOCUMENTS

| | | | |
|---|---|---|---|
| DE | 8800397 | U1 | 3/1988 |
| DE | 10113295 | A1 | 10/2002 |

(Continued)

*Primary Examiner* — Shin H Kim
(74) *Attorney, Agent, or Firm* — Kameron W. Kramer

(57) ABSTRACT

A perpetual calendar system comprising: a first array of letter positions, each letter position in the first array denoting a position corresponding to a digit in Gregorian numerical system; a second array of numbers corresponding to digits in the Gregorian numerical system; and a third array of symbols comprising a plurality of groups of years, wherein each group corresponds to a related letter position and a related number in the first array and the second array respectively, such that a combination of: the related letter position from the first array, the related number from the second array, and the plurality of groups of years in the third array is used to locate a calendar for a year of interest, and wherein the combination corresponds to a page index in the perpetual calendar system constituted by a plurality of pages, each page having a calendar identified by the corresponding page index.

20 Claims, 40 Drawing Sheets

| Gregorian Calendar | Kirschner Method |
|---|---|
| 1 | A |
| 2 | B |
| 3 | C |
| 11 | D |
| 6 | E |
| 7 | F |
| 1 | G |
| 9 | H |
| 4 | I |
| 5 | J |
| 6 | K |
| 14 | L |
| 2 | M |
| 3 | N |
| 4 | O |
| 12 | P |
| 7 | Q |
| 1 | R |
| 2 | S |
| 10 | T |
| 5 | U |
| 6 | V |
| 7 | W |
| 8 | X |
| 3 | Y |
| 4 | Z |
| 5 | ZZ |
| 13 | ZZZ |

Table showing the Gregorian calendar represented by numbers and the corresponding letters in the Kirschner Method

(56) References Cited

U.S. PATENT DOCUMENTS

| | | | | | |
|---|---|---|---|---|---|
| 3,166,862 | A * | 1/1965 | Jaickles | G09D 3/04 | 40/109 |
| 3,792,541 | A * | 2/1974 | Engle, Jr. | G09D 3/12 | 40/107 |
| 3,800,454 | A * | 4/1974 | Anderson | G09D 3/10 | 40/109 |
| 4,226,443 | A | 10/1980 | Brown | | |
| 4,813,707 | A * | 3/1989 | Habib | G09D 3/00 | 283/2 |
| 4,828,290 | A | 5/1989 | Harris | | |
| 5,026,095 | A | 6/1991 | Hoyeck | | |
| 5,655,319 | A * | 8/1997 | LeCompte | G09D 3/00 | 40/107 |
| 6,116,656 | A | 9/2000 | Glassman | | |
| 6,138,391 | A * | 10/2000 | Ngan | G09D 3/00 | 40/119 |
| 7,140,132 | B2 | 11/2006 | Barton | | |
| 7,830,751 | B2 | 11/2010 | Parees et al. | | |
| 2004/0047243 | A1* | 3/2004 | Karageorge | G09D 3/12 | 368/28 |

FOREIGN PATENT DOCUMENTS

| | | |
|---|---|---|
| GB | 2038042 A | 7/1980 |
| JP | 3112860 U3 | 7/2005 |

* cited by examiner

| Gregorian Calendar | Kirschner Method |
|---|---|
| 1 | A |
| 2 | B |
| 3 | C |
| 11 | D |
| 6 | E |
| 7 | F |
| 1 | G |
| 9 | H |
| 4 | I |
| 5 | J |
| 6 | K |
| 14 | L |
| 2 | M |
| 3 | N |
| 4 | O |
| 12 | P |
| 7 | Q |
| 1 | R |
| 2 | S |
| 10 | T |
| 5 | U |
| 6 | V |
| 7 | W |
| 8 | X |
| 3 | Y |
| 4 | Z |
| 5 | ZZ |
| 13 | ZZZ |

Fig. 1 - Table showing the Gregorian calendar represented by numbers and the corresponding letters in the Kirschner Method

| Gregorian Calendar | Kirschner Method | Color Pattern |
|---|---|---|
| 1 | A | Red |
| 2 | B | Orange |
| 3 | C | Yellow |
| 11 | D | Brown |
| 6 | E | Indigo |
| 7 | F | Violet |
| 1 | G | Red |
| 9 | H | Pink |
| 4 | I | Green |
| 5 | J | Blue |
| 6 | K | Indigo |
| 14 | L | Maroon |
| 2 | M | Orange |
| 3 | N | Yellow |
| 4 | O | Green |
| 12 | P | Gray |
| 7 | Q | Violet |
| 1 | R | Red |
| 2 | S | Orange |
| 10 | T | Copper |
| 5 | U | Blue |
| 6 | V | Indigo |
| 7 | W | Violet |
| 8 | X | Gold |
| 3 | Y | Yellow |
| 4 | Z | Green |
| 5 | ZZ | Blue |
| 13 | ZZZ | Cyan |

Fig. 2 - Table showing the Gregorian calendar represented by numbers, the corresponding Kirschner Method letter, and their corresponding color pattern

KIRSCHNER METHOD

BIRTH STAR in CONSTELLATION

| KIRSCHNER | COLOR | GREGORIAN | STAR | CONSTELLATION | BIRTH YEAR |
|---|---|---|---|---|---|
| A | RED | 1 | SIRIUS | CANIS MAJOR | 1933 1961 1989 2017 |
| B | ORANGE | 2 | CANOPUS | CARINA | 1934 1962 1990 2018 |
| C | YELLOW | 3 | RIGIL KENT | CENTAURUS | 1935 1963 1991 2019 |
| D | BROWN | 11 | ARCTURUS | BOOTES | 1936 1964 1992 2020 |
| E | INDIGO | 6 | VEGA | LYRA | 1937 1965 1993 2021 |
| F | VIOLET | 7 | CAPELLA | AURIGA | 1938 1966 1994 2022 |
| G | RED | 1 | RIGEL | ORION | 1939 1967 1995 2023 |
| H | PINK | 9 | PROCYON | CANIS MINOR | 1940 1968 1996 2024 |
| I | GREEN | 4 | BETELGEUSE | ORION | 1941 1969 1997 2025 |
| J | BLUE | 5 | ACHERNAR | ERIDANUS | 1942 1970 1998 2026 |
| K | INDIGO | 6 | HADAR | CENTAURUS | 1943 1971 1999 2027 |
| L | MAROON | 14 | ALTAIR | AQUILA | 1944 1972 2000 2028 |
| M | ORANGE | 2 | ACRUX | CRUX | 1945 1973 2001 2029 |
| N | YELLOW | 3 | ALDEBARAN | TAURUS | 1946 1974 2002 2030 |
| O | GREEN | 4 | SPICA | VIRGO | 1947 1975 2003 2031 |
| P | GRAY | 12 | ANTARES | SCORPIUS | 1948 1976 2004 2032 |
| Q | VIOLET | 7 | POLLUX | GEMINI | 1949 1977 2005 2033 |
| R | RED | 1 | FOMALHAUT | PISCIS AUSTRINUS | 1950 1978 2006 2034 |
| S | ORANGE | 2 | DENEB | CYGNUS | 1951 1979 2007 2035 |
| T | COPPER | 10 | MIMOSA | CRUX | 1952 1980 2008 2036 |
| U | BLUE | 5 | REGULUS | LEO | 1953 1981 2009 2037 |
| V | INDIGO | 6 | ADHARA | CANIS MAJOR | 1954 1982 2010 2038 |
| W | VIOLET | 7 | CASTOR | GEMINI | 1955 1983 2011 2039 |
| X | GOLD | 8 | GACRUX | CRUX | 1956 1984 2012 2040 |
| Y | YELLOW | 3 | SHAULA | SCORPIUS | 1957 1985 2013 2041 |
| Z | GREEN | 4 | BELLATRIX | ORION | 1958 1986 2014 2042 |
| ZZ | BLUE | 5 | EL NATH | TAURUS | 1959 1987 2015 2043 |
| ZZZ | CYAN | 13 | MIAPLACIDUS | CARINA | 1960 1988 2016 2044 |

Fig. 3 - Table showing the Kirschner Method letter, color, Gregorian value, star, constellation, and birth year Fig. 4 - Color pattern of the Kirschner Method also showing birth star design, birth position, and talisman symbol
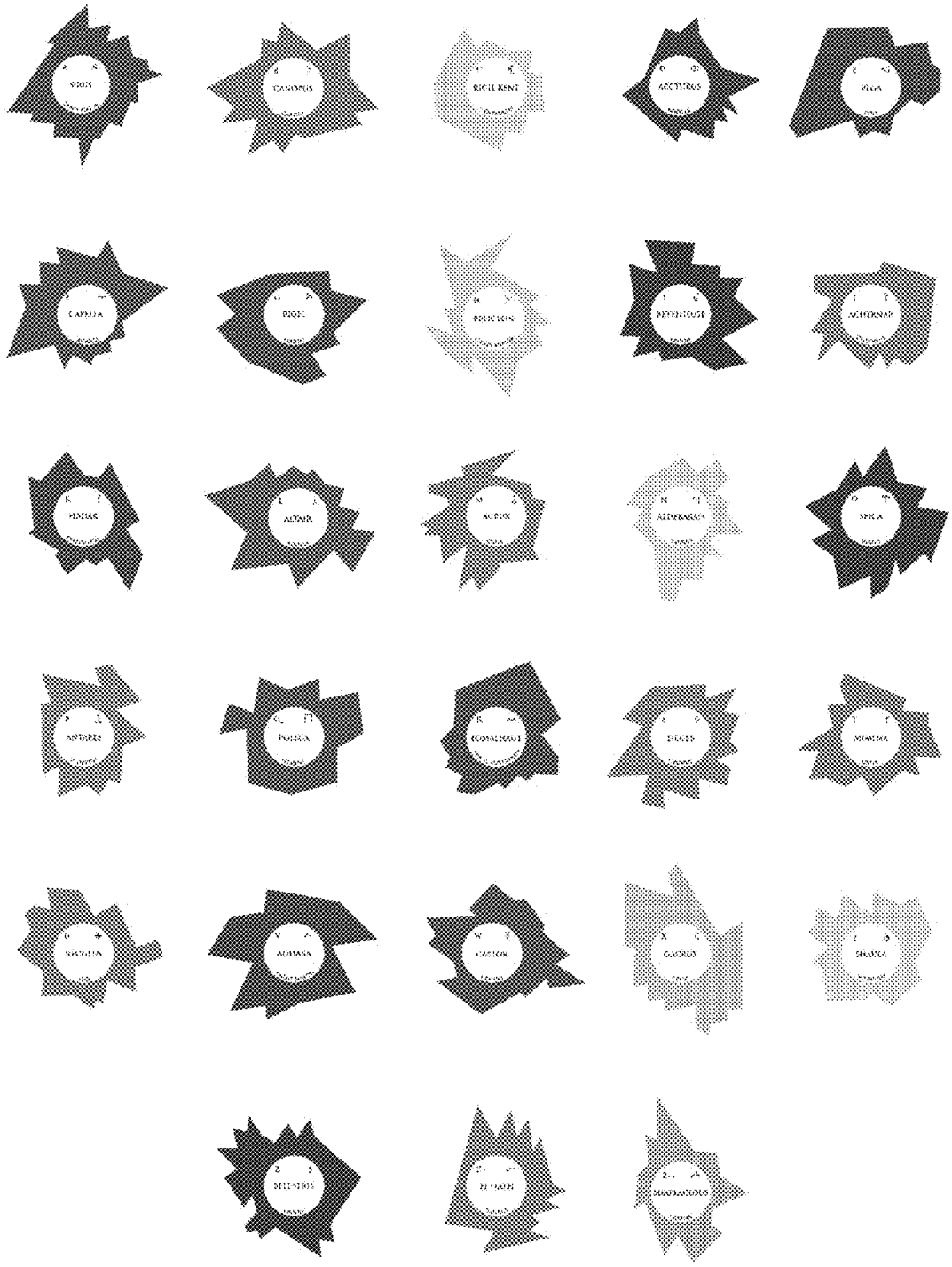

| POSITION | STAR | COLOR | CONSTELLATION | NUMBER |
|---|---|---|---|---|
| A | SIRIUS | RED | CANIS MAJOR | 14 |
| B | CANOPUS | ORANGE | CARINA | 1 |
| C | RIGIL KENT | YELLOW | CENTAURUS | 21 |
| D | ARCTURUS | BROWN | BOOTES | 15 |
| E | VEGA | INDIGO | LYRA | 23 |
| F | CAPELLA | VIOLET | AURIGA | 26 |
| G | RIGEL | RED | ORION | 28 |
| H | PROCYON | PINK | CANIS MINOR | 22 |
| I | BETELGEUSE | GREEN | ORION | 27 |
| J | ACHERNAR | BLUE | ERIDANUS | 3 |
| K | HADAR | INDIGO | CENTAURUS | 20 |
| L | ALTAIR | MAROON | AQUILA | 18 |
| M | ACRUX | ORANGE | CRUX | 25 |
| N | ALDEBARAN | YELLOW | TAURUS | 4 |
| O | SPICA | GREEN | VIRGO | 16 |
| P | ANTARES | GRAY | SCORPIUS | 17 |
| Q | POLLUX | VIOLET | GEMINI | 7 |
| R | FOMALHAUT | RED | PISCIS AUSTRINUS | 6 |
| S | DENEB | ORANGE | CYGNUS | 8 |
| T | MIMOSA | COPPER | CRUX | 9 |
| U | REGULUS | BLUE | LEO | 10 |
| V | ADHARA | INDIGO | CANIS MAJOR | 24 |
| W | CASTOR | VIOLET | GEMINI | 13 |
| X | GACRUX | GOLD | CRUX | 19 |
| Y | SHAULA | YELLOW | SCORPIUS | 5 |
| Z | BELLATRIX | GREEN | ORION | 11 |
| ZZ | EL NATH | BLUE | TAURUS | 2 |
| ZZZ | MIAPLACIDUS | CYAN | CARINA | 12 |

Fig. 5 - Table of the Kirschner Method showing position (Kirschner Method letter), star, color, constellation, and number

| POSITION | STAR | COLOR | CONSTELLATION | NUMBER |
|---|---|---|---|---|
| A | SIRIUS | RED | CANIS MAJOR | 14 |
| G | RIGEL | RED | ORION | 28 |
| R | FOMALHAUT | RED | PISCIS AUSTRINUS | 6 |
| B | CANOPUS | ORANGE | CARINA | 1 |
| M | ACRUX | ORANGE | CRUX | 25 |
| S | DENEB | ORANGE | CYGNUS | 8 |
| C | RIGIL KENT | YELLOW | CENTAURUS | 21 |
| N | ALDEBARAN | YELLOW | TAURUS | 4 |
| Y | SHAULA | YELLOW | SCORPIUS | 5 |
| D | ARCTURUS | BROWN | BOOTES | 15 |
| E | VEGA | INDIGO | LYRA | 23 |
| K | HADAR | INDIGO | CENTAURUS | 20 |
| V | ADHARA | INDIGO | CANIS MAJOR | 24 |
| F | CAPELLA | VIOLET | AURIGA | 26 |
| Q | POLLUX | VIOLET | GEMINI | 7 |
| W | CASTOR | VIOLET | GEMINI | 13 |
| H | PROCYON | PINK | CANIS MINOR | 22 |
| I | BETELGEUSE | GREEN | ORION | 27 |
| O | SPICA | GREEN | VIRGO | 16 |
| Z | BELLATRIX | GREEN | ORION | 11 |
| J | ACHERNAR | BLUE | ERIDANUS | 3 |
| U | REGULUS | BLUE | LEO | 10 |
| ZZ | EL NATH | BLUE | TAURUS | 2 |
| L | ALTAIR | MAROON | AQUILA | 18 |
| P | ANTARES | GRAY | SCORPIUS | 17 |
| T | MIMOSA | COPPER | CRUX | 9 |
| X | GACRUX | GOLD | CRUX | 19 |
| ZZZ | MIAPLACIDUS | CYAN | CARINA | 12 |

Fig. 6 - Table of the Kirschner Method showing position (Kirschner Method letter), star, color, constellation, and number grouped by colors.

| POSITION | STAR | COLOR | CONSTELLATION | NUMBER | PRINT | HEX |
|---|---|---|---|---|---|---|
| A | SIRIUS | RED | CANIS MAJOR | 14 | C8%M100%Y99%K1% | #db1f26 |
| G | RIGEL | RED | ORION | 28 | C8%M100%Y99%K1% | #db1f26 |
| R | FOMALHAUT | RED | PISCIS AUSTRINUS | 6 | C8%M100%Y99%K1% | #db1f26 |
| B | CANOPUS | ORANGE | CARINA | 1 | C0%M72%Y100%K0% | #ff6a00 |
| M | ACRUX | ORANGE | CRUX | 25 | C0%M72%Y100%K0% | #ff6a00 |
| S | DENEB | ORANGE | CYGNUS | 8 | C0%M72%Y100%K0% | #ff6a00 |
| C | RIGIL KENT | YELLOW | CENTAURUS | 21 | C6%M0%Y97%K0% | #ffff00 |
| N | ALDEBARAN | YELLOW | TAURUS | 4 | C6%M0%Y97%K0% | #ffff00 |
| Y | SHAULA | YELLOW | SCORPIUS | 5 | C6%M0%Y97%K0% | #ffff00 |
| D | ARCTURUS | BROWN | BOOTES | 15 | C34%M74%Y100%K36% | #301f0d |
| E | VEGA | INDIGO | LYRA | 23 | C88%M79%Y0%K0% | #324ab2 |
| K | HADAR | INDIGO | CENTAURUS | 20 | C88%M79%Y0%K0% | #324ab2 |
| V | ADHARA | INDIGO | CANIS MAJOR | 24 | C88%M79%Y0%K0% | #324ab2 |
| F | CAPELLA | VIOLET | AURIGA | 26 | C60%M86%Y0%K0% | #9400d7 |
| Q | POLLUX | VIOLET | GEMINI | 7 | C60%M86%Y0%K0% | #9400d7 |
| W | CASTOR | VIOLET | GEMINI | 13 | C60%M86%Y0%K0% | #9400d7 |
| H | PROCYON | PINK | CANIS MINOR | 22 | C0%M31%Y7%K0% | #ffc0cb |
| I | BETELGEUSE | GREEN | ORION | 27 | C89%M34%Y100%K28% | #016620 |
| O | SPICA | GREEN | VIRGO | 16 | C89%M34%Y100%K28% | #016620 |
| Z | BELLATRIX | GREEN | ORION | 11 | C89%M34%Y100%K28% | #016620 |
| J | ACHERNAR | BLUE | ERIDANUS | 3 | C66%M19%Y0%K0% | #00adff |
| U | REGULUS | BLUE | LEO | 10 | C66%M19%Y0%K0% | #00adff |
| ZZ | EL NATH | BLUE | TAURUS | 2 | C66%M19%Y0%K0% | #00adff |
| L | ALTAIR | MAROON | AQUILA | 18 | C26%M80%Y66%K13% | #a94c4c |
| P | ANTARES | GRAY | SCORPIUS | 17 | C50%M38%Y34%K2% | #878f97 |
| T | MIMOSA | COPPER | CRUX | 9 | C17%M62%Y99%K3% | #cb752b |
| X | GACRUX | GOLD | CRUX | 19 | C4%M18%Y100%K0% | #f6cb00 |
| ZZZ | MIAPLACIDUS | CYAN | CARINA | 12 | C54%M0%Y25%K0% | #00ffe6 |

Fig. 7 - Table of the Kirschner Method showing stars with same colors and the print Cyan Magenta Yellow Black ("CMYB") and hex codes

| KIRSCHNER | GREGORIAN | COLOR | STAR | CONSTELLATION | BIRTH YEAR | CMYK |
|---|---|---|---|---|---|---|
| A | 1 | RED | SIRIUS | CANIS MAJOR | 1933 1961 1989 2017 | C8%M100%Y99%K1% |
| B | 2 | ORANGE | CANOPUS | CARINA | 1934 1962 1990 2018 | C0%M72%Y100%K0% |
| C | 3 | YELLOW | RIGIL KENT | CENTAURUS | 1935 1963 1991 2019 | C6%M0%Y97%K0% |
| D | 11 | BROWN | ARCTURUS | BOOTES | 1936 1964 1992 2020 | C34%M74%Y100%K36% |
| E | 6 | INDIGO | VEGA | LYRA | 1937 1965 1993 2021 | C88%M79%Y0%K0% |
| F | 7 | VIOLET | CAPELLA | AURIGA | 1938 1966 1994 2022 | C60%M86%Y0%K0% |
| G | 1 | RED | RIGEL | ORION | 1939 1967 1995 2023 | C8%M100%Y99%K1% |
| H | 9 | PINK | PROCYON | CANIS MINOR | 1940 1968 1996 2024 | C0%M31%Y7%K0% |
| I | 4 | GREEN | BETELGEUSE | ORION | 1941 1969 1997 2025 | C89%M34%Y100%K28% |
| J | 5 | BLUE | ACHERNAR | ERIDANUS | 1942 1970 1998 2026 | C66%M19%Y0%K0% |
| K | 6 | INDIGO | HADAR | CENTAURUS | 1943 1971 1999 2027 | C88%M79%Y0%K0% |
| L | 14 | MAROON | ALTAIR | AQUILA | 1944 1972 2000 2028 | C26%M80%Y66%K13% |
| M | 2 | ORANGE | ACRUX | CRUX | 1945 1973 2001 2029 | C0%M72%Y100%K0% |
| N | 3 | YELLOW | ALDEBARAN | TAURUS | 1946 1974 2002 2030 | C6%M0%Y97%K0% |
| O | 4 | GREEN | SPICA | VIRGO | 1947 1975 2003 2031 | C89%M34%Y100%K28% |
| P | 12 | GRAY | ANTARES | SCORPIUS | 1948 1976 2004 2032 | C50%M38%Y34%K2% |
| Q | 7 | VIOLET | POLLUX | GEMINI | 1949 1977 2005 2033 | C60%M86%Y0%K0% |
| R | 1 | RED | FOMALHAUT | PISCIS AUSTRINUS | 1950 1978 2006 2034 | C8%M100%Y99%K1% |
| S | 2 | ORANGE | DENEB | CYGNUS | 1951 1979 2007 2035 | C0%M72%Y100%K0% |
| T | 10 | COPPER | MIMOSA | CRUX | 1952 1980 2008 2036 | C17%M62%Y99%K3% |
| U | 5 | BLUE | REGULUS | LEO | 1953 1981 2009 2037 | C66%M19%Y0%K0% |
| V | 6 | INDIGO | ADHARA | CANIS MAJOR | 1954 1982 2010 2038 | C88%M79%Y0%K0% |
| W | 7 | VIOLET | CASTOR | GEMINI | 1955 1983 2011 2039 | C60%M86%Y0%K0% |
| X | 8 | GOLD | GACRUX | CRUX | 1956 1984 2012 2040 | C4%M18%Y100%K0% |
| Y | 3 | YELLOW | SHAULA | SCORPIUS | 1957 1985 2013 2041 | C6%M0%Y97%K0% |
| Z | 4 | GREEN | BELLATRIX | ORION | 1958 1986 2014 2042 | C89%M34%Y100%K28% |
| ZZ | 5 | BLUE | EL NATH | TAURUS | 1959 1987 2015 2043 | C66%M19%Y0%K0% |
| ZZZ | 13 | CYAN | MIAPLACIDUS | CARINA | 1960 1988 2016 2044 | C54%M0%Y25%K0% |

Fig. 8 - Table of the Kirschner Method showing position (Kirschner Method letter), Gregorian number, color, star, constellation, birth year, and CMYK code

| KIRSCHNER | GREGORIAN | COLOR | STAR | CONSTELLATION | BIRTH YEAR | HEX |
|---|---|---|---|---|---|---|
| A | 1 | RED | SIRIUS | CANIS MAJOR | 1933 1961 1989 2017 | #db1f26 |
| B | 2 | ORANGE | CANOPUS | CARINA | 1934 1962 1990 2018 | #ff6a00 |
| C | 3 | YELLOW | RIGIL KENT | CENTAURUS | 1935 1963 1991 2019 | #ffff00 |
| D | 11 | BROWN | ARCTURUS | BOOTES | 1936 1964 1992 2020 | #301f0d |
| E | 6 | INDIGO | VEGA | LYRA | 1937 1965 1993 2021 | #324ab2 |
| F | 7 | VIOLET | CAPELLA | AURIGA | 1938 1966 1994 2022 | #9400d7 |
| G | 1 | RED | RIGEL | ORION | 1939 1967 1995 2023 | #db1f26 |
| H | 9 | PINK | PROCYON | CANIS MINOR | 1940 1968 1996 2024 | #ffc0cb |
| I | 4 | GREEN | BETELGEUSE | ORION | 1941 1969 1997 2025 | #016620 |
| J | 5 | BLUE | ACHERNAR | ERIDANUS | 1942 1970 1998 2026 | #00adff |
| K | 6 | INDIGO | HADAR | CENTAURUS | 1943 1971 1999 2027 | #324ab2 |
| L | 14 | MAROON | ALTAIR | AQUILA | 1944 1972 2000 2028 | #a94c4c |
| M | 2 | ORANGE | ACRUX | CRUX | 1945 1973 2001 2029 | #ff6a00 |
| N | 3 | YELLOW | ALDEBARAN | TAURUS | 1946 1974 2002 2030 | #ffff00 |
| O | 4 | GREEN | SPICA | VIRGO | 1947 1975 2003 2031 | #016620 |
| P | 12 | GRAY | ANTARES | SCORPIUS | 1948 1976 2004 2032 | #878f97 |
| Q | 7 | VIOLET | POLLUX | GEMINI | 1949 1977 2005 2033 | #9400d7 |
| R | 1 | RED | FOMALHAUT | PISCIS AUSTRINUS | 1950 1978 2006 2034 | #db1f26 |
| S | 2 | ORANGE | DENEB | CYGNUS | 1951 1979 2007 2035 | #ff6a00 |
| T | 10 | COPPER | MIMOSA | CRUX | 1952 1980 2008 2036 | #cb752b |
| U | 5 | BLUE | REGULUS | LEO | 1953 1981 2009 2037 | #00adff |
| V | 6 | INDIGO | ADHARA | CANIS MAJOR | 1954 1982 2010 2038 | #324ab2 |
| W | 7 | VIOLET | CASTOR | GEMINI | 1955 1983 2011 2039 | #9400d7 |
| X | 8 | GOLD | GACRUX | CRUX | 1956 1984 2012 2040 | #f6cb00 |
| Y | 3 | YELLOW | SHAULA | SCORPIUS | 1957 1985 2013 2041 | #ffff00 |
| Z | 4 | GREEN | BELLATRIX | ORION | 1958 1986 2014 2042 | #016620 |
| ZZ | 5 | BLUE | EL NATH | TAURUS | 1959 1987 2015 2043 | #00adff |
| ZZZ | 13 | CYAN | MIAPLACIDUS | CARINA | 1960 1988 2016 2044 | #00ffe6 |

Fig. 9 - Table of the Kirschner Method showing position (Kirschner Method letter), Gregorian number, color, star, constellation, birth year, and hex code

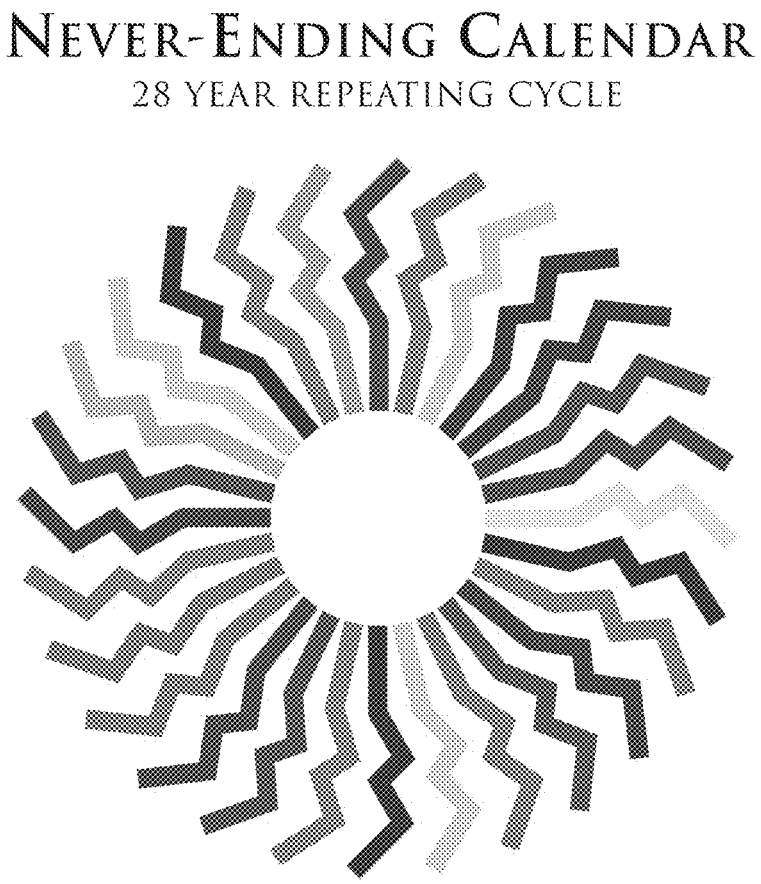
Fig. 10 - The never ending calendar of the present invention from A1-ZZZ13, which corresponds to 2017 - 2044 in Gregorian numbers. A1 begins the 28 year repeating cycle again in 2045

KIRSCHNER POSITIONAL METHOD

| KIRSCHNER | GREGORIAN | YEAR | COLOR | STAR | CONSTELLATION |
|---|---|---|---|---|---|
| A | 1 | 1933 1961 1989 2017 2045 | RED | SIRIUS | CANIS MAJOR |
| B | 2 | 1934 1962 1990 2018 2046 | ORANGE | CANOPUS | CARINA |
| C | 3 | 1935 1963 1991 2019 2047 | YELLOW | RIGIL KENT | CENTAURUS |
| D | 11 | 1936 1964 1992 2020 2048 | BROWN | ARCTURUS | BOÖTES |
| E | 6 | 1937 1965 1993 2021 2049 | INDIGO | VEGA | LYRA |
| F | 7 | 1938 1966 1994 2022 2050 | VIOLET | CAPELLA | AURIGA |
| G | 1 | 1939 1967 1995 2023 2051 | RED | RIGEL | ORION |
| H | 9 | 1940 1968 1996 2024 2052 | PINK | PROCYON | CANIS MINOR |
| I | 4 | 1941 1969 1997 2025 2053 | GREEN | BETELGEUSE | ORION |
| J | 5 | 1942 1970 1998 2026 2054 | BLUE | ACHERNAR | ERIDANUS |
| K | 6 | 1943 1971 1999 2027 2055 | INDIGO | HADAR | CENTAURUS |
| L | 14 | 1944 1972 2000 2028 2056 | MAROON | ALTAIR | AQUILA |
| M | 2 | 1945 1973 2001 2029 2057 | ORANGE | ACRUX | CRUX |
| N | 3 | 1946 1974 2002 2030 2058 | YELLOW | ALDEBARAN | TAURUS |
| O | 4 | 1947 1975 2003 2031 2059 | GREEN | SPICA | VIRGO |
| P | 12 | 1948 1976 2004 2032 2060 | GRAY | ANTARES | SCORPIUS |
| Q | 7 | 1949 1977 2005 2033 2061 | VIOLET | POLLUX | GEMINI |
| R | 1 | 1950 1978 2006 2034 2062 | RED | FOMALHAUT | PISCIS AUSTRINUS |
| S | 2 | 1951 1979 2007 2035 2063 | ORANGE | DENEB | CYGNUS |
| T | 10 | 1952 1980 2008 2036 2064 | COPPER | MIMOSA | CRUX |
| U | 5 | 1953 1981 2009 2037 2065 | BLUE | REGULUS | LEO |
| V | 6 | 1954 1982 2010 2038 2066 | INDIGO | ADHARA | CANIS MAJOR |
| W | 7 | 1955 1983 2011 2039 2067 | VIOLET | CASTOR | GEMINI |
| X | 8 | 1956 1984 2012 2040 2068 | GOLD | GACRUX | CRUX |
| Y | 3 | 1957 1985 2013 2041 2069 | YELLOW | SHAULA | SCORPIUS |
| Z | 4 | 1958 1986 2014 2042 2070 | GREEN | BELLATRIX | ORION |
| ZZ | 5 | 1959 1987 2015 2043 2071 | BLUE | EL NATH | TAURUS |
| ZZZ | 13 | 1960 1988 2016 2044 2072 | CYAN | MIAPLACIDUS | CARINA |

CALENDAR.A1

1933 | 1961 | 1989 | 2017 | 2045

TALISMAN

| JANUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| FEBRUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | | | | |

| MARCH | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| APRIL | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| MAY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| JUNE | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| JULY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| AUGUST | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| SEPTEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| OCTOBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| NOVEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| DECEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

NEVER-ENDING CALENDAR

28 YEAR REPEATING CYCLE

CALENDAR B2

1934 | 1962 | 1990 | 2018 | 2046

TALISMAN

| JANUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| FEBRUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | | | |

| MARCH | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| APRIL | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| MAY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| JUNE | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| JULY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| AUGUST | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| SEPTEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| OCTOBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| NOVEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| DECEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

NEVER-ENDING CALENDAR

28 YEAR REPEATING CYCLE

CALENDAR C3

1935 | 1963 | 1991 | 2019 | 2047

TALISMAN

| JANUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| FEBRUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | | |

| MARCH | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| APRIL | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| MAY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| JUNE | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| JULY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| AUGUST | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| SEPTEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| OCTOBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| NOVEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| DECEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

NEVER-ENDING CALENDAR

28 YEAR REPEATING CYCLE

CALENDAR D11 1936 | 1964 | 1992 | 2020 | 2048 TALISMAN

| JANUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| FEBRUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |

| MARCH | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| APRIL | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| MAY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| JUNE | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| JULY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| AUGUST | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| SEPTEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| OCTOBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| NOVEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| DECEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

NEVER-ENDING CALENDAR
28 YEAR REPEATING CYCLE

CALENDAR E6

1937 | 1965 | 1993 | 2021 | 2049

TALISMAN

| JANUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| FEBRUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | | | | | | |

| MARCH | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| APRIL | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| MAY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| JUNE | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| JULY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| AUGUST | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| SEPTEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| OCTOBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| NOVEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| DECEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

NEVER-ENDING CALENDAR

28 YEAR REPEATING CYCLE

CALENDAR F7

1938 | 1966 | 1994 | 2022 | 2050

TALISMAN

| JANUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| FEBRUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | | | | | |

| MARCH | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| APRIL | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| MAY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| JUNE | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| JULY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| AUGUST | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| SEPTEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| OCTOBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| NOVEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| DECEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

NEVER-ENDING CALENDAR

28 YEAR REPEATING CYCLE

CALENDAR G1

1939 | 1967 | 1995 | 2023 | 2051

TALISMAN

| JANUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| FEBRUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | | | | |

| MARCH | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| APRIL | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| MAY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| JUNE | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| JULY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| AUGUST | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| SEPTEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| OCTOBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| NOVEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| DECEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

NEVER-ENDING CALENDAR

28 YEAR REPEATING CYCLE

CALENDAR H9

1940 | 1968 | 1996 | 2024 | 2052

TALISMAN

| JANUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| FEBRUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | | |

| MARCH | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| APRIL | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| MAY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| JUNE | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| JULY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| AUGUST | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| SEPTEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| OCTOBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| NOVEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| DECEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

NEVER-ENDING CALENDAR

28 YEAR REPEATING CYCLE

CALENDAR 14

1941 | 1969 | 1997 | 2025 | 2053

TALISMAN

| JANUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| FEBRUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | |

| MARCH | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| APRIL | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| MAY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| JUNE | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| JULY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| AUGUST | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| SEPTEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| OCTOBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| NOVEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| DECEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

NEVER-ENDING CALENDAR

28 YEAR REPEATING CYCLE

CALENDAR J5 1942 | 1970 | 1998 | 2026 | 2054 ♀ TALISMAN

| JANUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| FEBRUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |

| MARCH | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| APRIL | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| MAY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| JUNE | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| JULY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| AUGUST | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| SEPTEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| OCTOBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| NOVEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| DECEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

NEVER-ENDING CALENDAR
28 YEAR REPEATING CYCLE

CALENDAR K6

1943 | 1971 | 1999 | 2027 | 2055

TALISMAN

| JANUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| FEBRUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | | | | | | |

| MARCH | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| APRIL | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| MAY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| JUNE | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| JULY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| AUGUST | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| SEPTEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| OCTOBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| NOVEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| DECEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

NEVER-ENDING CALENDAR

28 YEAR REPEATING CYCLE

CALENDAR L14

1944 | 1972 | 2000 | 2028 | 2056

TALISMAN

| JANUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| FEBRUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | | | | |

| MARCH | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| APRIL | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| MAY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| JUNE | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| JULY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| AUGUST | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| SEPTEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| OCTOBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| NOVEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| DECEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

NEVER-ENDING CALENDAR

28 YEAR REPEATING CYCLE

CALENDAR M2

1945 | 1973 | 2001 | 2029 | 2057

TALISMAN

| JANUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| FEBRUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | | | |

| MARCH | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| APRIL | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| MAY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| JUNE | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| JULY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| AUGUST | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| SEPTEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| OCTOBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| NOVEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| DECEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

NEVER-ENDING CALENDAR

28 YEAR REPEATING CYCLE

CALENDAR N3

1946 | 1974 | 2002 | 2030 | 2058

TALISMAN

| JANUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| FEBRUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | | |

| MARCH | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| APRIL | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| MAY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| JUNE | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| JULY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| AUGUST | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| SEPTEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| OCTOBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| NOVEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| DECEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

NEVER-ENDING CALENDAR

28 YEAR REPEATING CYCLE

CALENDAR 04

1947 | 1975 | 2003 | 2031 | 2059

TALISMAN

| JANUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| FEBRUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | |

| MARCH | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| APRIL | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| MAY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| JUNE | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| JULY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| AUGUST | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| SEPTEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| OCTOBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| NOVEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| DECEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

NEVER-ENDING CALENDAR

28 YEAR REPEATING CYCLE

CALENDAR P12

1948 | 1976 | 2004 | 2032 | 2060

TALISMAN

| JANUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| FEBRUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | | | | | | |

| MARCH | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| APRIL | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| MAY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| JUNE | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| JULY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| AUGUST | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| SEPTEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| OCTOBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| NOVEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| DECEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

NEVER-ENDING CALENDAR

28 YEAR REPEATING CYCLE

CALENDAR Q7

1949 | 1977 | 2005 | 2033 | 2061

TALISMAN

JANUARY

| Su | Mo | Tu | We | Th | Fr | Sa |
|---|---|---|---|---|---|---|
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

FEBRUARY

| Su | Mo | Tu | We | Th | Fr | Sa |
|---|---|---|---|---|---|---|
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | | | | | |

MARCH

| Su | Mo | Tu | We | Th | Fr | Sa |
|---|---|---|---|---|---|---|
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

APRIL

| Su | Mo | Tu | We | Th | Fr | Sa |
|---|---|---|---|---|---|---|
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

MAY

| Su | Mo | Tu | We | Th | Fr | Sa |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

JUNE

| Su | Mo | Tu | We | Th | Fr | Sa |
|---|---|---|---|---|---|---|
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

JULY

| Su | Mo | Tu | We | Th | Fr | Sa |
|---|---|---|---|---|---|---|
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

AUGUST

| Su | Mo | Tu | We | Th | Fr | Sa |
|---|---|---|---|---|---|---|
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

SEPTEMBER

| Su | Mo | Tu | We | Th | Fr | Sa |
|---|---|---|---|---|---|---|
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

OCTOBER

| Su | Mo | Tu | We | Th | Fr | Sa |
|---|---|---|---|---|---|---|
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

NOVEMBER

| Su | Mo | Tu | We | Th | Fr | Sa |
|---|---|---|---|---|---|---|
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

DECEMBER

| Su | Mo | Tu | We | Th | Fr | Sa |
|---|---|---|---|---|---|---|
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

NEVER-ENDING CALENDAR

28 YEAR REPEATING CYCLE

CALENDAR R1 1950 | 1978 | 2006 | 2034 | 2062 TALISMAN

| JANUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| FEBRUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | | | | |

| MARCH | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| APRIL | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| MAY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| JUNE | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| JULY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| AUGUST | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| SEPTEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| OCTOBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| NOVEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| DECEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

NEVER-ENDING CALENDAR
28 YEAR REPEATING CYCLE

CALENDAR S2

1951 | 1979 | 2007 | 2035 | 2063

TALISMAN

| JANUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| FEBRUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | | | |

| MARCH | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| APRIL | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| MAY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| JUNE | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| JULY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| AUGUST | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| SEPTEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| OCTOBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| NOVEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| DECEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

NEVER-ENDING CALENDAR

28 YEAR REPEATING CYCLE

CALENDAR T10

1952 | 1980 | 2008 | 2036 | 2064

TALISMAN

| JANUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| FEBRUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | |

| MARCH | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| APRIL | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| MAY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| JUNE | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| JULY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| AUGUST | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| SEPTEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| OCTOBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| NOVEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| DECEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

NEVER-ENDING CALENDAR

28 YEAR REPEATING CYCLE

CALENDAR U5

1953 | 1981 | 2009 | 2037 | 2065

TALISMAN

| JANUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| FEBRUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |

| MARCH | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| APRIL | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| MAY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| JUNE | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| JULY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| AUGUST | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| SEPTEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| OCTOBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| NOVEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| DECEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

NEVER-ENDING CALENDAR

28 YEAR REPEATING CYCLE

CALENDAR V6 | 1954 | 1982 | 2010 | 2038 | 2066 | TALISMAN

| JANUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| FEBRUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | | | | | | |

| MARCH | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| APRIL | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| MAY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| JUNE | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| JULY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| AUGUST | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| SEPTEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| OCTOBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| NOVEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| DECEMBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

NEVER-ENDING CALENDAR
28 YEAR REPEATING CYCLE

CALENDAR W7

1955 | 1983 | 2011 | 2039 | 2067

TALISMAN

| JANUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| FEBRUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | | | | | |

| MARCH | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| APRIL | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| MAY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| JUNE | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| JULY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| AUGUST | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| SEPTEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| OCTOBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| NOVEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| DECEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

NEVER-ENDING CALENDAR

28 YEAR REPEATING CYCLE

CALENDAR X8

1956 | 1984 | 2012 | 2040 | 2068

TALISMAN

| JANUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| FEBRUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | | | |

| MARCH | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| APRIL | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| MAY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| JUNE | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| JULY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| AUGUST | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| SEPTEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| OCTOBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| NOVEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| DECEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

NEVER-ENDING CALENDAR

28 YEAR REPEATING CYCLE

CALENDAR Y3

1957 | 1985 | 2013 | 2041 | 2069

TALISMAN

| JANUARY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| FEBRUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | | |

| MARCH | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| APRIL | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| MAY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| JUNE | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| JULY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| AUGUST | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| SEPTEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| OCTOBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| NOVEMBER | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| DECEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

NEVER-ENDING CALENDAR

28 YEAR REPEATING CYCLE

CALENDAR Z4

1958 | 1986 | 2014 | 2042 | 2070

TALISMAN

| JANUARY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| FEBRUARY | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | |

| MARCH | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| APRIL | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| MAY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| JUNE | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| JULY | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| AUGUST | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| SEPTEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| OCTOBER | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| NOVEMBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | | | | | | |

| DECEMBER | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

NEVER-ENDING CALENDAR

28 YEAR REPEATING CYCLE

CALENDAR ZZ5 1959 | 1987 | 2015 | 2043 | 2071 TALISMAN

| JANUARY | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| FEBRUARY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |

| MARCH | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| APRIL | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| MAY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| JUNE | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | | | | |

| JULY | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

| AUGUST | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| SEPTEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| OCTOBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

| NOVEMBER | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

| DECEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

NEVER-ENDING CALENDAR
28 YEAR REPEATING CYCLE

CALENDAR ZZZ13

1960 | 1988 | 2016 | 2044 | 2072

TALISMAN

| JANUARY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| FEBRUARY | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | | | | | |

| MARCH | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | 31 | | |

| APRIL | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |

| MAY | | | | | | |
|---|---|---|---|---|---|---|
| Su | Mo | Tu | We | Th | Fr | Sa |
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |

| JUNE | | | | | | |
|---|---|---|---|---|---|---|
| Su | Mo | Tu | We | Th | Fr | Sa |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | | |

| JULY | | | | | | |
|---|---|---|---|---|---|---|
| Su | Mo | Tu | We | Th | Fr | Sa |
| | | | | | 1 | 2 |
| 3 | 4 | 5 | 6 | 7 | 8 | 9 |
| 10 | 11 | 12 | 13 | 14 | 15 | 16 |
| 17 | 18 | 19 | 20 | 21 | 22 | 23 |
| 24 | 25 | 26 | 27 | 28 | 29 | 30 |
| 31 | | | | | | |

| AUGUST | | | | | | |
|---|---|---|---|---|---|---|
| Su | Mo | Tu | We | Th | Fr | Sa |
| | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | | | |

| SEPTEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | |

| OCTOBER | | | | | | |
|---|---|---|---|---|---|---|
| Su | Mo | Tu | We | Th | Fr | Sa |
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

| NOVEMBER | | | | | | |
|---|---|---|---|---|---|---|
| Su | Mo | Tu | We | Th | Fr | Sa |
| | | 1 | 2 | 3 | 4 | 5 |
| 6 | 7 | 8 | 9 | 10 | 11 | 12 |
| 13 | 14 | 15 | 16 | 17 | 18 | 19 |
| 20 | 21 | 22 | 23 | 24 | 25 | 26 |
| 27 | 28 | 29 | 30 | | | |

| DECEMBER | | | | | | |
|---|---|---|---|---|---|---|
| Su | Mo | Tu | We | Th | Fr | Sa |
| | | | | 1 | 2 | 3 |
| 4 | 5 | 6 | 7 | 8 | 9 | 10 |
| 11 | 12 | 13 | 14 | 15 | 16 | 17 |
| 18 | 19 | 20 | 21 | 22 | 23 | 24 |
| 25 | 26 | 27 | 28 | 29 | 30 | 31 |

NEVER-ENDING CALENDAR

28 YEAR REPEATING CYCLE

First Array | Second Array | Third Array | Fourth Array | Fifth Array | Sixth Array

| KIRSCHNER | GREGORIAN | YEAR | COLOR | STAR | CONSTELLATION |
|---|---|---|---|---|---|
| A | 1 | 1933 1961 1989 2017 2045 | RED | SIRIUS | CANIS MAJOR |
| B | 2 | 1934 1962 1990 2018 2046 | ORANGE | CANOPUS | CARINA |
| C | 3 | 1935 1963 1991 2019 2047 | YELLOW | RIGIL KENT | CENTAURUS |
| D | 11 | 1936 1964 1992 2020 2048 | BROWN | ARCTURUS | BOÖTES |
| E | 6 | 1937 1965 1993 2021 2049 | INDIGO | VEGA | LYRA |
| F | 7 | 1938 1966 1994 2022 2050 | VIOLET | CAPELLA | AURIGA |
| G | 1 | 1939 1967 1995 2023 2051 | RED | RIGEL | ORION |
| H | 9 | 1940 1968 1996 2024 2052 | PINK | PROCYON | CANIS MINOR |
| I | 4 | 1941 1969 1997 2025 2053 | GREEN | BETELGEUSE | ORION |
| J | 5 | 1942 1970 1998 2026 2054 | BLUE | ACHERNAR | ERIDANUS |
| K | 6 | 1943 1971 1999 2027 2055 | INDIGO | HADAR | CENTAURUS |
| L | 14 | 1944 1972 2000 2028 2056 | MAROON | ALTAIR | AQUILA |
| M | 2 | 1945 1973 2001 2029 2057 | ORANGE | ACRUX | CRUX |
| N | 3 | 1946 1974 2002 2030 2058 | YELLOW | ALDEBARAN | TAURUS |
| O | 4 | 1947 1975 2003 2031 2059 | GREEN | SPICA | VIRGO |
| P | 12 | 1948 1976 2004 2032 2060 | GRAY | ANTARES | SCORPIUS |
| Q | 7 | 1949 1977 2005 2033 2061 | VIOLET | POLLUX | GEMINI |
| R | 1 | 1950 1978 2006 2034 2062 | RED | FOMALHAUT | PISCIS AUSTRINUS |
| S | 2 | 1951 1979 2007 2035 2063 | ORANGE | DENEB | CYGNUS |
| T | 13 | 1952 1980 2008 2036 2064 | COPPER | MIMOSA | CRUX |
| U | 5 | 1953 1981 2009 2037 2065 | BLUE | REGULUS | LEO |
| V | 6 | 1954 1982 2010 2038 2066 | INDIGO | ADHARA | CANIS MAJOR |
| W | 7 | 1955 1983 2011 2039 2067 | VIOLET | CASTOR | GEMINI |
| X | 8 | 1956 1984 2012 2040 2068 | GOLD | GACRUX | CRUX |
| Y | 3 | 1957 1985 2013 2041 2069 | YELLOW | SHAULA | SCORPIUS |
| Z | 4 | 1958 1986 2014 2042 2070 | GREEN | BELLATRIX | ORION |
| ZZ | 5 | 1959 1987 2015 2043 2071 | BLUE | EL NATH | TAURUS |
| ZZZ | 13 | 1960 1988 2016 2044 2072 | CYAN | MIAPLACIDUS | CARINA |

Fig. 11 - Table showing the arrays of the Kirschner Method

NEVER-ENDING CALENDAR

CROSS-REFERENCE TO RELATED APPLICATION

This application claims the benefit of U.S. Provisional Patent Application Ser. No. 63/089,810 filed Oct. 9, 2020, titled "NEVER-ENDING CALENDAR" and the subject matter thereof is incorporated herein by reference thereto.

TECHNICAL FIELD

The present invention relates to calendars, and more specifically, a perpetual calendar system that creates, translates, and displays a plurality of calendar systems and events.

BACKGROUND ART

There are several calendar systems that are widely-used today. The Western world largely uses the Gregorian calendar system, while other parts of the world use other calendar systems, such as the Chinese calendar, the Jewish calendar, the Islamic calendar, and the Indian calendar. Each calendar is unique in various aspects, such as the naming of days, weeks, months, and years. This can obviously create confusion throughout the world. One thing that is almost universal is the starting over of the calendar every year and the need to purchase a new calendar at a year's end.

The present invention, known as the Kirschner Method: Never-Ending Calendar (shortened to the Kirschner Method), by inventor Kenneth Neal Kirschner, began as a project of curiosity leading up to the second millennium or year 2000. Hearing all the confusion about Y2K and what came to be known as the 2012 Phenomenon (end of the Great Cycle Long Count component of the Mayan calendar), Kirschner began to study the history and mathematical sequence of the Gregorian calendar. After much research, Kirschner realized that the Gregorian calendar took 28 years to complete one cycle and begin the next cycle in exactly the same sequence. To make this 28-year non-sequential numbering system easier to understand, he developed the Kirschner Positional Method using the 26 letters of the English alphabet, adding ZZ and ZZZ, for two additional characters to equal 28 positions. Instead of tossing last year's calendar and buying a new year, the present invention allows the user to save and reuse the calendars marking each year with a positional cipher.

The calendar of the present invention allows for the realization of mutual connectedness, much like astrology. The present invention provides easily accessible information of any user, including, but not limited to, birth year position, personal birth star in a constellation, talisman symbol, lucky day of the week, and chakra colors of the week, in addition to the ability to be used perpetually over a lifetime There is a need for a universal calendar with an interchangeable nature making it perpetual, while also providing additional information to the user. The present invention overcomes the shortcoming contained in the prior art. The calendar of the present invention simplifies the complexity of the original Gregorian non-sequential numerical calendar sequence and provides additional elements.

Certain embodiments of the invention have other steps or elements in addition to or in place of those mentioned above. The steps or element will become apparent to those skilled in the art from a reading of the following detailed description when taken with reference to the accompanying figures.

BRIEF DESCRIPTION OF THE DRAWINGS

FIG. 1 is a table showing the Gregorian calendar represented by numbers and the corresponding in the Kirschner Method letter.

FIG. 2 is a table showing the Gregorian calendar represented by numbers, the corresponding Kirschner Method, and their corresponding color pattern.

FIG. 3 is a table showing the Kirschner Method letter, color, Gregorian value, Star, Constellation, and Birth Year.

FIG. 4 illustrates the color pattern of the Kirschner Method (the present invention) along with the birth star design, birth position, and talisman symbol.

FIG. 5 is a table showing position, star, color, constellation, and number of the Kirschner Method.

FIG. 6 is a table of the Kirschner Method (the present invention) showing position, star, color, constellation, and number grouped by colors.

FIG. 7 is a table of the Kirschner Method (the present invention) showing stars with same colors and the print Cyan Magenta Yellow Black ("CMYB") and hex codes.

FIG. 8 is a table of the Kirschner Method showing position (Kirschner Method letter), Gregorian number, color, star, constellation, birth year, and CMYK code.

FIG. 9 is table of the Kirschner Method showing position (Kirschner Method letter), Gregorian number, color, star, constellation, birth year, and hex code.

FIG. 10 shows the never ending calendar of the present invention from A1-ZZZ13, which corresponds to 2017-2044 in Gregorian numbers. A1 begins the 28 year repeating cycle again in 2045.

FIG. 11 is a table showing the arrays of the Kirschner Method (the present invention).

DETAILED DESCRIPTION OF THE INVENTION

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

It is noted that, as used in this specification and the appended claims, the singular forms "a," "an," and "the" include plural referents unless expressly and unequivocally limited to referent. Additionally, "plurality" means one or more. As used herein the term "include" and its grammatical variants are intended to be non-limiting, such that recitation of items in a list is not to the exclusion of other like items that can be substituted or other items that can be added to the listed items.

The present invention comprises a perpetual calendar, known as the Kirschner Method, that creates, translates, and displays a plurality of calendar systems and events. The term "Kirschner Method" shall generally refer to the present invention when used herein. "Kirschner Method" and "present invention" are used interchangeably. Generally, the calendar of the present invention provides a never-ending calendar that uses a cycle of 28 years. The calendar of the present invention uses a novel positional method whereby individuals can easily determine their birth year position, personal birth star in a constellation, talisman symbol, lucky day of the week, and chakra colors of the week. The calendar of the present invention includes various symbols, colors, letters, and numbers.

The calendar of the present invention substitutes the 26 letters of the English alphabet and adds two extra positions, ZZ and ZZZ, for the equivalent of 28 years. The complexity of the original Gregorian non-sequential numerical system (hereafter referred to as the Gregorian calendar) is made more understandable, precise and personal by the present invention. The key to this novel method replaces the non-sequential numerical system with letter positions. For example, the first digit of the Gregorian calendar is number 1. The present invention replaces this digit with position A. The second digit, number 2, is replaced by position B. The third digit, number 3, is replaced by position C. Not in numerical sequence, the fourth digit, number 11, is replaced by position D. See FIG. 1: Table showing the Gregorian calendar represented by numbers and the corresponding letters in the Kirschner Method (the present invention).

The calendar of the present invention assigns colors to the numbers of the Gregorian calendar to simplify visual identification of repeating and non-repeating patterns. There are 14 different calendars in the Gregorian calendar and the calendar of the present invention. Those numbered one through seven repeat three times during the 28-year cycle, while those numbered eight through fourteen occur only once in a cycle as leap years. The calendar of the present invention comprises corresponding color pattern for numbers one through seven also repeat three times; while leap year colors occur only once for those numbered eight through fourteen. See FIG. 2: Table showing the Gregorian calendar represented by numbers, the corresponding letters in the Kirschner Method (the present invention), and their corresponding color pattern.

According to the apparent visual magnitude of the 28 brightest naked-eye stars in the Milky Way Galaxy, the calendar of the present invention identifies a personal birth star in a constellation and depicts a talisman symbol for each position of the 28 years. From the brightest naked-eye star, Sirius in Canis Major, to the least-brightest of the 28, Miaplacidus in Carina, the calendar of the present invention uses the precise apparent visual magnitude of the naked-eye stars to determine each star's position in relationship to the birth year position. See FIG. 3: Table showing the Kirschner Method letter, color, Gregorian value, Star, Constellation, and Birth Year.

When viewing the naked-eye stars from earth, twinkling lights with spikes of shimmering brightness are seen. The calendar of the present invention imagines these stars have specific shapes. In drawing each of the 28 naked-eye stars, the calendar of the present invention creates unique structures for each personal birth year star connected to each position of the calendar of the present invention. For happiness, the calendar of the present invention adds a distinctive talisman symbol to bring good luck to all birth year positions. The colors of birth year stars correspond to the color pattern of the present invention. See FIG. 4: Color pattern of the Kirschner Method (the present invention) along with the birth star design, birth position, and talisman symbol.

The calendar of the present invention uses the chakra colors to highlight the days of the week: Root Chakra, Red—Sunday; Sacral Chakra, Orange—Monday; Solar Plexus Chakra, Yellow—Tuesday; Heart Chakra, Green—Wednesday; Throat Chakra, Blue—Thursday; Third Eye Chakra, Indigo—Friday; and Crown Chakra, Violet—Saturday.

FIG. 5 is a table of the Kirschner Method (the present invention) showing position, star, color, constellation, and number. The word "position" when used throughout the figures and herein refers to the Kirschner method letter as provided in FIGS. 1-3

FIG. 6 is a table of the Kirschner Method (the present invention) showing position, star, color, constellation, and number grouped by colors. As in FIG. 5, the position is the same as the Kirschner Method letter as show in the previous Figures.

FIG. 7 is a table of the Kirschner Method (the present invention) showing stars with same colors and the print Cyan Magenta Yellow Black ("CMYB") and hex codes. Hex codes are used in HTML, CSS, SVG, and other computing applications to represent colors.

FIG. 8 is a table of the Kirschner Method (the present invention) showing position (Kirschner Method letter), Gregorian number, color, star, constellation, birth year, and CMYK code. The CMYK (Cyan Magenta Yellow Black) code is the color code used in the printing process.

FIG. 9 is table showing the Kirschner Method (the present invention)—Birth Star in Constellation and corresponding hex code.

The calendar of the present invention provides a new paradigm for measuring one's life in cycles of 28-year segments. From birth to 28 years is the first segment. The second section is from 29 to 56 years of age. From 57 to 84 years of age is the third sector, and the fourth division represents age 85 to 112 years.

The calendar system of the present invention can be manifested in several different embodiments including, but not limited to, a wall calendar, color coded diaries, electronic desk and electronic wall calendars, computer programs, and the like means for calendaring.

While the corresponding letters for the present invention are shown in FIG. 10 for years 2017 through 2044, the calendar system of the present invention can be extended prior to 2017 and in perpetuity beyond 2044 by following the same rules and patterns provided in the present disclosure.

FIG. 11 is a table showing the arrays of the Kirschner Method. The arrays are as follows:

First Array—Kirschner letter also referred to as "letter position" (also labeled as Kirschner Method in some drawings/references)

Second Array—Gregorian numerical system number

Third Array—Year

Fourth Array—Color

Fifth Array—Birth star identifiers

Sixth Array—Constellation identifiers

The present invention provides a perpetual calendar system (the Kirshner Method) comprising: a first array of letter positions (the Kirschner Method letter), each letter position in the first array denoting a position corresponding to a digit in Gregorian numerical system; a second array of numbers corresponding to digits in the Gregorian numerical system; and a third array of symbols comprising a plurality of groups of years, wherein each group corresponds to a related letter position and a related number in the first array and the second array respectively, such that a combination of: the related letter position from the first array, the related number from the second array, and the plurality of groups of years in the third array is used to locate a calendar for a year of interest, and wherein the combination corresponds to a page index in the perpetual calendar system constituted by a plurality of pages, each page having a calendar identified by the corresponding page index. The first array of letter positions comprises 28 letter positions such that first 26 letter positions in a sequential order from top to bottom correspond to 26 letters of the English alphabet, and subsequent last two letter positions in the sequential order from top to bottom after the first 26 letter positions correspond to two respective additional letter patterns. The subsequent last two letter positions correspond to the additional letter patterns ZZ and ZZZ respectively. The second array of numbers comprises digits from 1 to 14 corresponding to years in the Gregorian numerical system, such that the digits 1 to 7 correspond to non-leap years and the digits 8 to 14 correspond to leap years respectively in the Gregorian numerical system. The year of interest is associated with at least one group in the plurality of groups of years in the third array, and wherein to locate a calendar for the year of interest in the perpetual calendar system: the year of interest is located in the third array by a navigation unit configured to navigate to at least one group in the plurality of groups of years in the third array; the navigation unit is further configured to navigate sequentially to the first array and the second array in that order, and determine the related letter position from the first array and the related number from the second array respectively based on the located at least one group; determination of the page index is performed by combining the related letter position and the related number; and the navigation unit is further configured to navigate to the page of the perpetual calendar system associated with the determined page index, to display the calendar of the year of interest. Navigation unit refers to any mechanism that can be used to navigate to the year of interest.

The present invention further provides a fourth array comprising a plurality of color pattern identifiers, wherein each color pattern identifier is associated with a corresponding digit in the second array; a fifth array comprising a plurality of birth star identifiers, each birth star identifier being associated with a corresponding letter position in the first array, wherein each birth star identifier is associated with a name of a star which is one of 28 brightest naked eye stars in the Milky way galaxy; and a sixth array comprising a plurality of constellation identifiers, wherein each constellation identifier is associated with a corresponding birth star identifier in the fifth array.

The perpetual calendar system (the Kirshner Method) comprises at least 28 pages corresponding to 28 different yearly calendars, and wherein the 28 yearly calendars are associated one cycle, and wherein each cycle of 28 yearly calendars is repeated to perpetually identify a calendar of any year of interest. Each page in the perpetual calendar system is configured to display at least: a page index on a top left section of the page, the page index formed by a combination of a letter position from the first array and a digit from the second array; a header corresponding to a group of years from the third array in top middle section of the page; a talisman symbol at top right section of the page; and a calendar comprising months, days, and dates spanning across the middle and the bottom sections of the page. Some digits in the second array are repeated multiple times to represent a corresponding calendar in the Gregorian numerical system.

In an alternate embodiment, the present invention comprises a computer-implemented method, the method being implemented by a computer program product comprising a non-transitory computer readable medium having stored there on a computer program comprising computer executable instructions which when executed by one or more processors, cause the one or more processors to carry out operations for locating a year of interest in a perpetual calendar system. The operations comprise the following: accessing the perpetual calendar system including: a plurality of pages with each page having a calendar identified by a corresponding page index, a first array of letter positions, each letter position in the first array denoting a position corresponding to a digit in Gregorian numerical system, a second array of numbers corresponding to digits in the Gregorian numerical system, and a third array of symbols comprising a plurality of groups of years, wherein each group corresponds to a related letter position and a related number in the first array and the second array respectively; determining at least one group in the plurality of groups of years in the third array, the at least one group being associated with the year of interest such that the year of interest is one or the years in the at least one group; determining the related letter position from the first array and the related number from the second array respectively that are associated with the at least one group; generating a combination of the related letter position and the related number to form a page index; and navigating to the page of the perpetual calendar system associated with the determined page index to locate the year of interest in the perpetual calendar system.

The computer-implemented method further comprises operations for displaying the page including a calendar associated with the located year of interest, and/or displaying a color pattern identifier, a birth star identifier, a constellation identifier, a talisman symbol identifier, and the page index on the page including a calendar associated with the located year of interest.

One or more processors of the computer program is further configured to: display the page including a calendar associated with the located year of interest; and/or display a color pattern identifier, a birth star identifier, a constellation identifier, a talisman symbol identifier and the page index on the page including a calendar associated with the located year of interest.

In an alternate embodiment of the present invention, the present invention comprises an apparatus that provides the perpetual calendar, the apparatus comprising: a first array of letter positions, each letter position in the first array denoting a position corresponding to a digit in Gregorian numerical system; a second array of numbers corresponding to digits in the Gregorian numerical system; and a third array of symbols comprising a plurality of groups of years, wherein each group corresponds to a related letter position and a related number in the first array and the second array respectively, such that a combination of: the related letter position from the first array, the related number from the second array, and the plurality of groups of years in the third array is used to locate a calendar for a year of interest, and wherein the combination corresponds to a page index in the perpetual calendar system constituted by a plurality of pages with each page having a calendar identified by the corresponding page index.

In an alternate embodiment of the present invention, the apparatus of the present invention comprises a medium, including, but not limited to, a wall calendar, a color-coded diary, an electronic desk, an electronic wall calendar, a computer including computer program associated with instructions for locating the year of interest and a memory configured for storing the computer program.

In an alternate embodiment of the present invention, the Kirschner Method comprises supplementary components of hierarchical arrays ad infinitum, such as scientific, natural, and man-made stratified systems of ranked order to align in ranked order with the position letters beginning with A and ending with ZZZ.

In an alternate embodiment of the present invention, the first three arrays shown in FIG. 11 comprise supplementary components of hierarchical arrays ad infinitum to create other calendars using scientific, natural, and/or man-made stratified systems of ranked order to align in ranked order with the Kirschner Method letters beginning with A and ending with ZZZ.

In an alternate embodiment of the present invention, any number of arrays are replaced with other names, letters, words, characters, or any other identifying symbol.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying drawings are to be interpreted in an illustrative and non-limiting sense.

I claim:

1. A perpetual calendar system comprising:

a first array of letter positions, each letter position in the first array denoting a position corresponding to a digit in Gregorian numerical system;

a second array of numbers corresponding to digits in the Gregorian numerical system; and a third array of symbols comprising a plurality of groups of years, wherein each group corresponds to a related letter position and a related number in the first array and the second array respectively, such that a combination of: the related letter position from the first array, the related number from the second array, and the plurality of groups of years in the third array is used to locate a calendar for a year of interest, and wherein the combination corresponds to a page index in the perpetual calendar system constituted by a plurality of pages, each page having a calendar identified by the corresponding page index.

2. The perpetual calendar system of claim 1, wherein the first array of letter positions comprises 28 letter positions such that first 26 letter positions in a sequential order from top to bottom correspond to 26 letters of the English alphabet, and subsequent last two letter positions in the sequential order from top to bottom after the first 26 letter positions correspond to two respective additional letter patterns.

3. The perpetual calendar system of claim 2, wherein the subsequent last two letter positions correspond to the additional letter patterns ZZ and ZZZ respectively.

4. The perpetual calendar system of claim 1, wherein the second array of numbers comprises digits from 1 to 14 corresponding to years in the Gregorian numerical system, such that the digits 1 to 7 correspond to non-leap years and the digits 8 to 14 correspond to leap years respectively in the Gregorian numerical system.

5. The perpetual calendar system of claim 1, wherein the year of interest is associated with at least one group in the plurality of groups of years in the third array, and wherein to locate a calendar for the year of interest in the perpetual calendar system:

the year of interest is located in the third array by a navigation unit configured to navigate to at least one group in the plurality of groups of years in the third array;

the navigation unit is further configured to navigate sequentially to the first array and the second array in that order, and determine the related letter position from the first array and the related number from the second array respectively based on the located at least one group;

determination of the page index is performed by combining the related letter position and the related number; and the navigation unit is further configured to navigate to the page of the perpetual calendar system associated with the determined page index, to display the calendar of the year of interest.

6. The perpetual calendar system of claim 1, further comprising:

a fourth array comprising a plurality of color pattern identifiers, wherein each color pattern identifier is associated with a corresponding digit in the second array;

a fifth array comprising a plurality of birth star identifiers, each birth star identifier being associated with a corresponding letter position in the first array, wherein each birth star identifier is associated with a name of a star which is one of 28 brightest naked eye stars in the Milky way galaxy; and a sixth array comprising a plurality of constellation identifiers, wherein each constellation identifier is associated with a corresponding birth star identifier in the fifth array.

7. The perpetual calendar system of claim 1, wherein the perpetual calendar system comprises at least 28 pages corresponding to 28 different yearly calendars, and wherein the 28 yearly calendars are associated one cycle, and wherein each cycle of 28 yearly calendars is repeated to perpetually identify a calendar of any year of interest.

8. The perpetual calendar system of claim 1, wherein each page in the perpetual calendar system is configured to display at least:

a page index on a top left section of the page, the page index formed by a combination of a letter position from the first array and a digit from the second array;

a header corresponding to a group of years from the third array in top middle section of the page;

a talisman symbol at top right section of the page; and a calendar comprising months, days, and dates spanning across the middle and the bottom sections of the page.

9. The perpetual calendar system of claim 1, wherein some digits in the second array are repeated multiple times to represent a corresponding calendar in the Gregorian numerical system.

10. A computer-implemented method, the method being implemented by a computer program product comprising a non-transitory computer readable medium having stored there on a computer program comprising computer executable instructions which when executed by one or more processors, cause the one or more processors to carry out operations for locating a year of interest in a perpetual calendar system, the operations comprising:

accessing the perpetual calendar system including: a plurality of pages with each page having a calendar identified by a corresponding page index, a first array of letter positions, each letter position in the first array denoting a position corresponding to a digit in Gregorian numerical system, a second array of numbers corresponding to digits in the Gregorian numerical system, and a third array of symbols comprising a plurality of groups of years, wherein each group corresponds to a related letter position and a related number in the first array and the second array respectively;

determining at least one group in the plurality of groups of years in the third array, the at least one group being associated with the year of interest such that the year of interest is one or the years in the at least one group;

determining the related letter position from the first array and the related number from the second array respectively that are associated with the at least one group;

generating a combination of the related letter position and the related number to form a page index; and navigating to the page of the perpetual calendar system associated with the determined page index to locate the year of interest in the perpetual calendar system.

11. The computer-implemented method of claim 10, further comprising operations for:

displaying the page including a calendar associated with the located year of interest.

12. The computer-implemented method of claim 11, further comprising operations for:

displaying a color pattern identifier, a birth star identifier, a constellation identifier, a talisman symbol identifier, and the page index on the page including a calendar associated with the located year of interest.

13. An apparatus providing a perpetual calendar, the apparatus comprising:

a first array of letter positions, each letter position in the first array denoting a position corresponding to a digit in Gregorian numerical system;

a second array of numbers corresponding to digits in the Gregorian numerical system; and a third array of symbols comprising a plurality of groups of years, wherein each group corresponds to a related letter position and a related number in the first array and the second array respectively, such that a combination of: the related letter position from the first array, the related number from the second array, and the plurality of groups of years in the third array is used to locate a calendar for a year of interest, and wherein the combination corresponds to a page index in the perpetual calendar system constituted by a plurality of pages with each page having a calendar identified by the corresponding page index.

14. The apparatus of claim 13, further comprising:

a navigation unit configured to:

determine a year of interest;

locate the year of interest in the third array, wherein the year of interest is one of the years in at least one group in the plurality of groups of years in the third array;

determine sequentially, the first array and the second array in that order, and corresponding related letter position from the first array and the related number from the second array respectively based on the located at least one group;

determine a page index by combining the related letter position and the related number; and navigate to the page of the perpetual calendar system associated with the determined page index, to display the calendar of the year of interest.

15. The apparatus of claim 13, comprising at least one of: a wall calendar, a color-coded diary, an electronic desk, an electronic wall calendar, a computer including computer program associated with instructions for locating the year of interest and a memory configured for storing the computer program.

16. The apparatus of claim 13, wherein the first array of letter positions comprises 28 letter positions such that first 26 letter positions in a sequential order from top to bottom correspond to 26 letters of the English alphabet, and subsequent last two letter positions in the sequential order from top to bottom after the first 26 letter positions correspond to two respective additional letter patterns.

17. The apparatus of claim 16, wherein the subsequent last two letter positions correspond to the additional letter patterns ZZ and ZZZ respectively.

18. The apparatus of claim 13, wherein the second array of numbers comprises digits from 1 to 14 corresponding to years in the Gregorian numerical system, such that the digits 1 to 7 correspond to non-leap years and the digits 8 to 14 correspond to leap years respectively in the Gregorian numerical system.

19. The apparatus of claim 13, further comprising:

a fourth array comprising a plurality of color pattern identifiers, wherein each color pattern identifier is associated with a corresponding digit in the second array;

a fifth array comprising a plurality of birth star identifiers, each birth star identifier being associated with a corresponding letter position in the first array, wherein each birth star identifier is associated with a name of a star which is one of 28 brightest naked eye stars in the Milky way galaxy; and a sixth array comprising a plurality of constellation identifiers, wherein each constellation identifier is associated with a corresponding birth star identifier in the fifth array.

20. The apparatus of claim 13, wherein each page in the perpetual calendar system is configured to display at least:

a page index on a top left section of the page, the page index formed by a combination of a letter position from the first array and a digit from the second array;

a header corresponding to a group of years from the third array in top middle section of the page;

a talisman symbol at top right section of the page; and a calendar comprising months, days, and dates spanning across the middle and the bottom sections of the page.

* * * * *